United States Patent [19]

Kibler

[11] 4,084,864

[45] Apr. 18, 1978

[54] SCISSOR STYLE PAPER CLIP AND AUTOMATIC DISPENSER FOR SAME

[76] Inventor: Nelson S. Kibler, 246 Avondale Dr., Sterling, Va. 22170

[21] Appl. No.: 704,951

[22] Filed: Jul. 13, 1976

[51] Int. Cl.[2] ..... A47F 1/08; B65D 83/08

[52] U.S. Cl. ..... 312/42; 29/814; 206/338; 221/312 C; 24/DIG. 10

[58] Field of Search ..... 24/261 PC, DIG. 10; 29/212 P, 814; 206/338; 221/312 R, 312 B, 312 C; 312/42

[56] References Cited

U.S. PATENT DOCUMENTS

| | | | |
|---|---|---|---|
| 2,383,207 | 8/1945 | Morrell | 221/312 A |
| 2,976,095 | 3/1961 | Taves | 312/42 |
| 3,324,538 | 6/1967 | Christensen | 29/212 P |
| 3,429,421 | 2/1969 | Macondray et al. | 29/212 P |

FOREIGN PATENT DOCUMENTS

| | | | |
|---|---|---|---|
| 186,567 | 10/1935 | Switzerland | 24/261 PC |

*Primary Examiner*—Kenneth J. Dorner

[57] ABSTRACT

This invention relates to a device to temporarily hold a plurality of objects, which device is commonly known as a paper clip, and a related device to automatically affix and dispense said paper clips. The invention advances the art in that the shape claimed results in a paper clip which is easier to affix manually, will facilitate dispensing by an automatic dispenser claimed herein and will be both simple and economical to manufacture. This invention also advances the art in that the related dispenser will store and hold ready a supply of said paper clips for dispensing and will automatically affix and dispense said clips on object(s) inserted into the dispensing device.

1 Claim, 8 Drawing Figures

SCISSOR STYLE PAPER CLIP AND AUTOMATIC DISPENSER FOR SAME

SUMMARY OF THE INVENTION

Paper clips commonly in use must be affixed manually. The paper clip herein claimed will accomplish the same objective of securing temporarily a plurality of objects, as is the objective of the designs currently in use, and will also have the facility of being readily affixed and dispensed by an automatic paper clip dispenser herein claimed by the same inventor. The paper clip claimed herein also advances the current art in that is is easier to manually affix, requiring only that the operator align the aperture at the front of the device with the object(s) and slide forward the device onto the object(s). Where, on the other hand, current models of paper clips require the operator to manually spread the gripping surface before the device can be affixed to the object(s). Additionally, the ability to store, affix and dispense automatically paper clips onto the object(s) through a dispensing device also advances the art in that no other device for such purpose is known to currently exist by the inventor. Therefore, the principal objectives of this invention are as follows:

- to provide a simply constructed paper clip which may be more easily affixed to the object than paper clips currently in use;
- to provide a paper clip which may be readily stored, affixed and dispensed to the object(s) through a related automatic dispensing device;
- to provide a device to conveniently and neatly store said paper clips in anticipation of use;
- to provide a device to conveniently and readily provide access to said paper clips by automatically affixing and dispensing said paper clip to the object(s) when the object(s) is inserted into the device manually by a person or otherwise; and
- to provide an efficient paper clip and dispensing device for same which is economical in manufacture, durable in use and refined in appearance.

These and other objectives will be apparent to those skilled in the art.

SPECIFICATIONS

My invention consists in the construction, arrangement and combination of the various parts of the paper clip and its dispensing device, whereby the objects contemplated are attained as hereinafter more fully set forth, specifically pointed out in my claims, and illustrated in the accompanying drawings in which:

Figure 4:
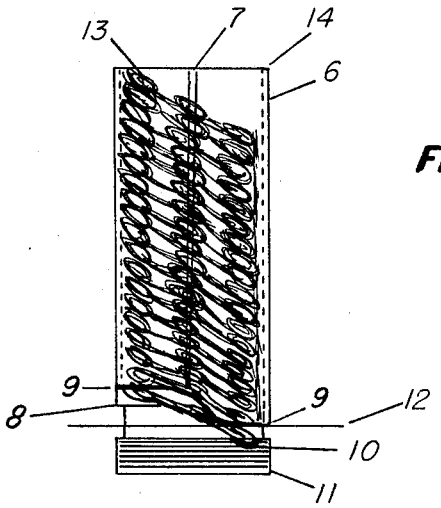
Figure 5:
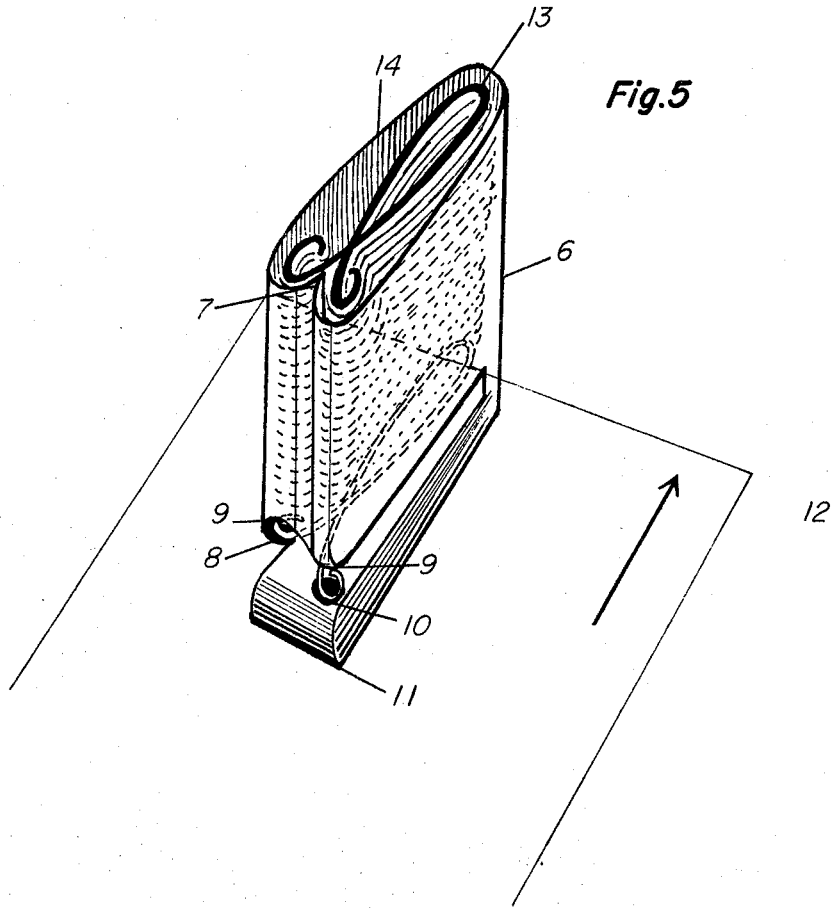

FIGS. *3a, b, c* and *d* are top views of various alternative styles for various applications of my paper clip design;

FIG. 4 is a front sectional view of the paper clip stored in the dispenser ready for dispensing; and FIG. 5 is a ¾ frontal view of the dispenser more fully showing its construction and operation.

Figure 1:
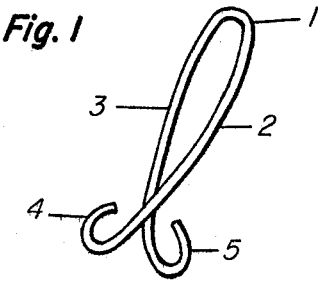
FIG. 1 is a perspective view of my paper clip design.
Figure 2:
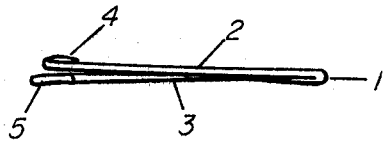
FIG. 2 is a horizontal view of my paper clip design.
Figure 3:
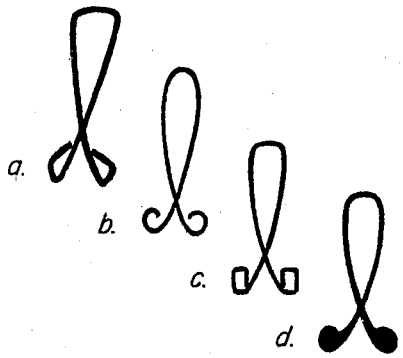

In these drawings I have used the number 1 to designate the heel, or rear, of the paper clip. The number 2 designates the right shank of the paper clip. The number 3 designates the left shank of the paper clip. The number 4 designates the left pad, or end, of the right shank. The number 5 designates the right pad, or end, of the left shank. The number 6 designates the upper housing, or tubular column, of the dispensing device. The number 7 designates the guide at the front of the upper housing 6 of the dispensing device which acts to align, hold straight and secure the paper clips within the dispenser prior to their use. The number 8 designates the lip attached to, or which is part of the upper housing 6, which holds the left pad 4 of the paper clip in position for dispensing. The number 9 designates the rim of the opening, one edge of which is bounded by the upper housing 6, from which the paper clips are dispensed one at a time affixed to the object(s). The number 10 designated the slot, or notch, in the face of the dispensing device in which the right pad 5 of the paper clip is held prior to the paper clip being dispensed. The number 11 designates the base of the dispensing device and the lower edge of the opening through which the paper clips are dispensed. The number 12 is used to designate the object(s), generally a plurality of paper, onto which the paper clips are, or are to be, affixed. The number 13 designates, in general, paper clips held in the dispensing device. And the number 14 designates the rim formed by the top of the upper housing. The opening bounded by the rim, 14, is the entrance through which the paper clips 13 are inserted into the dispensing device. The paper clips, as the drawings in FIGS. 1, 2 and 3 indicate are generally lengths of wire, or other similar material which are bent in the middle creating a "U" shape with the heel 1 and two shanks right 1 and left 2 which are further bent to cross at approximately two-thirds of the overall length of the paper clip. The ends so crossed are bent over to form pads right 5 and left 4.

My invention will operate generally in the following manner. The paper clip itself may be used manually by a person who will generally hold the clip as is convenient and natural for him in one hand. The object(s) is then brought to the opening between the right and left pads 4 and 5 and the clip is pushed forward onto the object until the heel 1 is firm against the object(s). The pressure between the shanks 2 and 3 and the pads 4 and 5 create friction which will hold the object(s) together.

The paper clip also may be dispensed and affixed on to the object(s) automatically through the dispensing device in the following manner. The paper clips are inserted into the dispensing device through the opening formed by the rim 14 in the upper housing 6 either one by one, or in a group, which group may be held together permitting the stacking of a plurality of clips for this purpose by inserting a flat metal, cardboard or similarly constructed rod through the opening between the shanks 2 and 3 and the heel 1.

When inserted with the dispensing device, the heel of the paper clip 1 is to the rear of the upper housing and the opening between the pads 4 and 5 are on either side of the guide in the front of the upper housing 6. The number of paper clips, the height of the upper housing and the exact dimensions of the paper clip and the dispensing device will vary porportionally with the specific application and number of object(s) that particular paper clip model is designed to accommodate.

The exact shape of the interior of the upper housing 6 will approximate the shape and size of the paper clip produced for use therein, so that the paper clip will fall precisely into the proper position for affixing it to the object(s) and dispensing through the aperture of the dispensing device 8, 9, 10 and 11, but with enough tolerance so that it will fall freely by action of gravity without binding along the length of the upper housing 6. When the first paper clip inserted into the dispensing device as described above comes to rest at the aperture of the dispensing device at 8, 9, 10 and 11 just clear of the guide 7 at the front of the upper housing 6, all other paper clips subsequently inserted will rest on top of and be stored in the dispensing device ready for future use. The bottom paper clip, the first one inserted as described above, rests, ready to be affixed to the object(s) and dispensed, with its left pad 4 resting on the lip 8 of the upper housing 6. The right pad 5 rests in the notch, or slot 10, in the base, 11. The lip 8 and the notch 10 in the base 11 thus create a slight angle between the pads, 4 and 5, of the paper clip which will permit the object(s) to be inserted therein. The lip 8 has a slight curvature of its outside edge which will catch and hold the paper clip and prevent it from sliding out and the notch 10 in the base will have a slight cup or cavity to facilitate the same purpose. These will not be so pronounced as to restrict withdrawal of the paper clip when properly affixed to the object(s).

The object(s) is inserted horizontally to the rear of the base 11 and the upper housing 6 by a person or otherwise with a slight left to right action. The spot on the object where the clip is desired is aligned with the center of the gap between pads 4 and 5 which are resting at a slight angle. The next paper clip which is resting as described above to be affixed and dispensed will have dropped down clear of the upper housing 6 at the top of the aperture 9 and also clear of the guide in the upper housing 7 so that the object(s) will be guided and aligned as it is inserted into the device at the gap between the pads, 4 and 5, of the paper clip and the slight angle that the paper clip is held in the dispenser which is created by the lip in the upper housing 8 and paper clip resting on the notch 10 in the base 11. As the object(s) is removed, generally by pulling forward toward the front of the device by the person or otherwise the friction created by the pressure between the shanks, 2 and 3, and the pads, 4 and 5, of the bottom most paper clip acts to grip the object(s) firmly and as the object(s) is withdrawn from the dispensing device the paper clip is extracted from the dispenser affixed to the object(s).

The paper clip may be constructed from metal, or other suitable material, which may be easily formed into the desired shape but will have sufficient resistence to flex and hold its shape to provide the desired pressure, between the shanks, 2 and 3, and pads, 4 and 5, to grasp the object(s) in the above described manner. The strength, size and exact dimensions of the material used will vary according to the variety of uses for which they may be designed and constructed. In some applications it may be appropriate to flaten the heel as in FIG. 3(a) so that the heel 1 will not protrude as much when affixed to thicker object(s). Also, the metal may be twisted, scored or indented in order to provide more friction to better grip the surface of the object(s). Likewise the dispensing device may be constructed of various metals or other suitable material, in the dimensions and finish appropriate for the size and dimension of the paper clips to be dispensed therefrom and for the uses for which the paper clip and dispenser may be designed and utilized.

In my drawings, I have shown the paper clip design wherein from the top view the right shank 2 crosses over the top of the left shank 3 in its construction. Its construction may also involve the left shank 3 crossing over the top of the right shank 2. In which case, the construction of the dispensing device must be changed also, wherein the lip 8 and the notch 10 in the base 11 would be reversed. In such case, viewing from the front of the dispensing device, the notch 10 would be on the left side of the base 11 and the lip 8 would be on the right side of the upper housing 6.

Some changes may be made in the construction and arrangement of my paper clip and its dispensing device without departing from the real spirit and purpose of my invention and it is my intention to cover my claims any modified forms of structure or use of mechanical equivalents which may be reasonably included within their scope.

I claim:

1. In combination, a device for dispensing paper clips and a paper clip, said device comprising guide means, a base, a vertical tubular housing, a notch in said base, a lip, and a space between said housing and said base, said lip being disposed at a lower end of said housing and above said space, said notch being disposed in said base and below said space, said paper clip comprising a length of resilient wire having a bend portion at the midpoint whereby two shanks are formed, said shanks crossing each other at substantially two-thirds of their length, said shanks being bent at their free ends to form pads, whereby when said paper clips are stacked in said device, said guide mates with a gap between said pads and the lowermost paper clip in said space of said device is supported by said pads which engage said lip and said notch, and whereby when a sheet of paper or similar material is placed in said space, said lowermost paper clip engages said sheet and is removed with said sheet when said sheet is withdrawn from said space.

* * * * *